US008662419B2

(12) United States Patent
Chang

(10) Patent No.: US 8,662,419 B2
(45) Date of Patent: Mar. 4, 2014

(54) MULTIFUNCTIONAL SPRAYING MINERAL WATER BOTTLE

(76) Inventor: Chang Ho Chang, Taoyuan (TW)

( * ) Notice: Subject to any disclaimer, the term of this patent is extended or adjusted under 35 U.S.C. 154(b) by 268 days.

(21) Appl. No.: 12/757,202

(22) Filed: Apr. 9, 2010

(65) Prior Publication Data

US 2011/0180629 A1 Jul. 28, 2011

Related U.S. Application Data

(63) Continuation-in-part of application No. 12/696,047, filed on Jan. 28, 2010, now abandoned.

(51) Int. Cl.
*B65D 1/32* (2006.01)

(52) U.S. Cl.
USPC ..... 239/327; 222/209; 222/211; 239/337; 239/463; 239/469; 239/487

(58) Field of Classification Search
USPC ..... 222/206, 209, 211, 215; 239/327, 337, 239/463, 469, 470, 487, 488
See application file for complete search history.

(56) References Cited

U.S. PATENT DOCUMENTS 3,572,590 A * 3/1971 Malone ..... 239/327
4,673,110 A * 6/1987 Workum ..... 222/211
5,156,307 A * 10/1992 Callahan et al. ..... 222/190
2002/0179735 A1* 12/2002 Santagiuliana ..... 239/327
2008/0087692 A1* 4/2008 Yu ..... 222/633

* cited by examiner

*Primary Examiner* — Jason Boeckmann
(74) *Attorney, Agent, or Firm* — Garcia-Zamor IP Law; Ruy M. Garcia-Zamor

(57) ABSTRACT

The invention discloses a multifunctional spraying mineral water bottle, including: an elastic deformation bottle, wherein there is an opening in the bottle; a bottle top, wherein the bottle top has a liquid-tight manner connection with the opening of the bottle and there is an axial through-hole in the bottle top; a sprayer unit that includes corner joint, atomization spool valve and nozzle, wherein the corner joint is composed by an fixed standpipe and a hollow tube that has an included angle with the fixed standpipe, and the fixed standpipe has a liquid-tight manner and interference fit joint with the axial through-hole of the bottle top, and inside the hollow tube has a cylindrical cavity wherein the cylindrical cavity holds the atomization spool valve and coordinates with the nozzle; the outer wall of the atomization spool valve has at least two water guide tanks, and there is an atomized tank corresponding to the water guide tank which is in the end of atomization spool valve corresponding to the end of the water guide tank; there is a spray hole which is coaxial with the atomization spool valve in the axial position of the nozzle section, and the spray hole is connected with the atomized tank. The invention not only ensures the drinking for mineral water, but also by squeezing the bottle to spray, so as to reduce the temperature around the human body, and to make the settlement by the combination of dust and mist, so that people feel more cool, fresh and comfortable.

13 Claims, 7 Drawing Sheets

MULTIFUNCTIONAL SPRAYING MINERAL WATER BOTTLE

CROSS REFERENCE TO RELATED APPLICATION

This application is a continuation in part of and claims benefit of and priority to U.S. patent application Ser. No. 12/696,047, filed on Jan. 28, 2010, which is hereby incorporated by reference herein as if set forth in its entirety.

TECHNICAL FIELD

The invention relates to mineral water bottle, especially refers to a portable multifunctional spraying mineral water bottle to adjust the air environment surrounding the human body.

BACKGROUND ART

The mineral water bottle in current technology, including bottle and bottle top, wherein the bottle has an opening, while outside the opening has screw thread, and inside the bottle top has screw thread, so that the bottle top has a liquid-tight manner connection with the bottle. The mineral water bottle has merits with simple structure, low cost and portable. However, this mineral water bottle has single feature, which unable to meet people's needs.

CONTENTS OF THE INVENTION

Aiming at the shortcomings above in existing technology, the invention is to provide a portable multifunctional spraying mineral water bottle for drinking or to adjust the air environment surrounding the human body by spraying.

For achieving the objective above, this invention adopts the following technical solution:

A multifunctional spraying mineral water bottle, including:

An elastic deformation bottle, wherein there is an opening in the bottle;

A bottle top, wherein the bottle top has a liquid-tight manner connection with the opening of the bottle and there is an axial through-hole in the bottle top;

A sprayer unit that includes corner joint, atomization spool valve and nozzle, wherein the corner joint is composed by a fixed standpipe and a hollow tube that has an included angle with the fixed standpipe, and the fixed standpipe has a liquid-tight manner and interference fit joint with the axial through-hole of the bottle top, and inside the hollow tube has a cylindrical cavity wherein the cylindrical cavity holds the atomization spool valve and coordinates with the nozzle; the external wall of the atomization spool valve has at least two water guide tanks, and there is an atomized tank corresponding to the water guide tank which is in the end of atomization spool valve corresponding to the end of the water guide tank; there is a spray hole which is coaxial with the atomization spool valve in the axial position of the nozzle section, and the spray hole is connected with the atomized tank.

The foresaid corner joint is composed by a fixed standpipe and a hollow tube that has an 90 degree included angle with the fixed standpipe, and the inside wall of the fixed standpipe has a cross-shaped atomization spool valve prop that is coaxial with the cylindrical cavity.

The foresaid external wall of the atomization spool valve has four central symmetry water guide tanks, and there is an atomized tank in the end of atomization spool valve corresponding to the end of the water guide tank; the atomized tank includes a cylindrical tank and four connecting tanks that separately connects with the water guide tanks, and one end of the two inner walls of each connecting tank separately connects with the two inner walls of the water guide tanks, and the other end contacts with the circumferential surface of the cylindrical tank.

The foresaid front end of the nozzle has a notch and a cap body that coordinates with the notch.

The foresaid cap body is placed in the front end of the hollow tube of the corner joint, wherein the cap body connects with the hollow tube by an elastic interconnecting piece.

The foresaid the rear end of the nozzle is cylindrical, wherein the atomization spool valve has a concentric interference fit joint with the cylinder, while the rear end cylinder of the nozzle has a liquid-tight manner connection with the cylindrical cavity of the corner joint.

Inside the foresaid spray hole has a conical cavity which is coaxial with the spray hole, wherein the diameter of the rear section of the conical cavity is coordinate with the diameter of the cylindrical tank and the atomized tank, while the diameter of the front end section is the same with the bore diameter of the spray hole The inside wall of the foresaid axial through-hole has an annular notch, while there is an annular convexity in the fixed standpipe corresponding to the location of the annular notch, and the annular convexity has a liquid-tight manner connection with the annular notch.

The foresaid cap body has a nozzle bracket corresponding to the place of the nozzle, wherein the bracket includes cylindrical body in both sides and the cambered supporting bracket in the middle of the two cylindrical bodies.

The foresaid cap body has an inner cover, wherein the inner cover movably connects with the cap body by an elastic interconnecting piece; in the surface of the cap body has an annular spacing convexity, wherein the outer diameter of the annular spacing convexity in coordination with the inside diameter of the inner cover, the front end of the cap body has a clip device, wherein the clip device is composed by the block in the inner cover and the card slot in the annular spacing convexity.

By adopting the above structure, a multifunctional spraying mineral water bottle of the invention not only ensures the drinking for mineral water, but also by manually squeeze the bottle, to deform the bottle, which increase the pressure of the bottle, so that the water flow through to the fixed standpipe by the axial through-hole in the bottle top, and by the water guide tank to the atomized tank and spray from the spray hole, to realize the spraying or drinking. Wherein, in one embodiment, any air that enters and any liquid that is expelled from the multifunctional spaying mineral water bottle uses a common and single fluid path. Meanwhile, during the outdoors or in the surrounding environment of heavy dust and hot weather, the portable air-conditioning unit of the invention, by means of inverting the mineral water bottle, and turning the nozzle to human body or surroundings, then squeezing the bottle, to achieve the spraying in the air, so as to reduce the temperature around the human body, meanwhile to make the settlement by the combination of dust and mist, so that people feel more cool, fresh and comfortable. The invention has merits of simple structure, practical and big market potential.

MODE OF CARRYING OUT THE INVENTION

Figure 1:
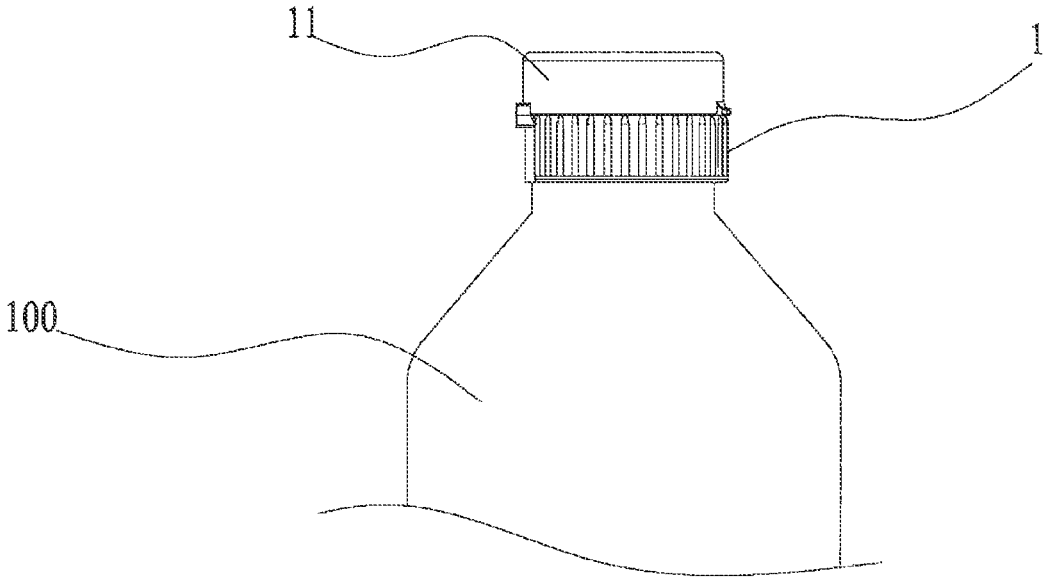
FIG. 1 is the structure drawing of the invention.
Figure 2:
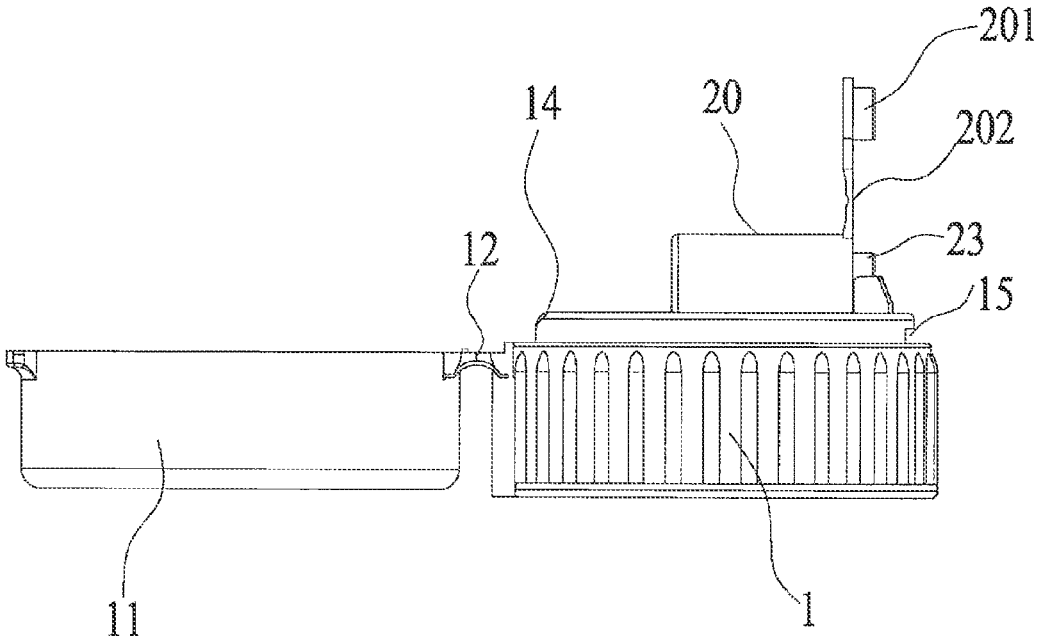
FIG. 2 is the structure drawing of the bottle top.
Figure 3:
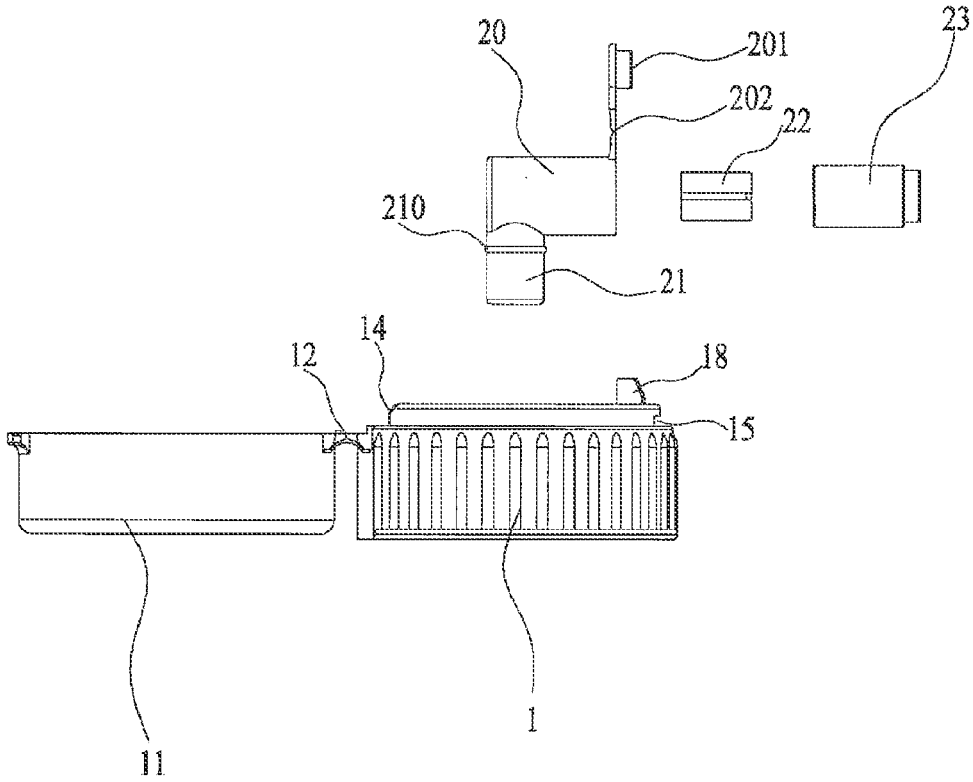
FIG. 3 is the exploded view of the FIG. 2.
Figure 4:
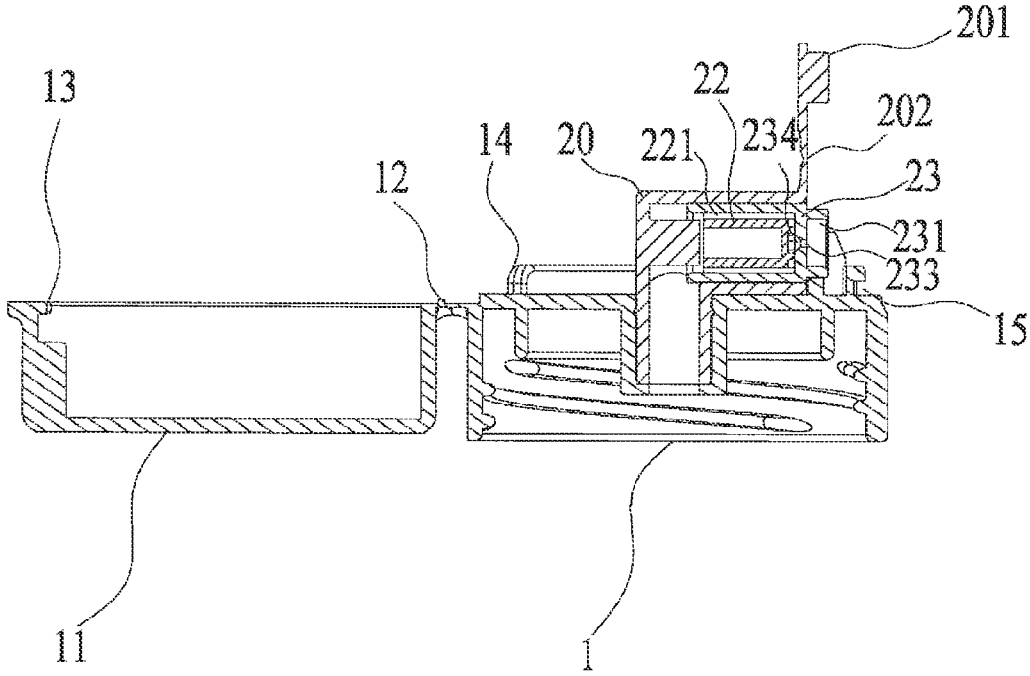
FIG. 4 is the cutaway view of the FIG. 2.
Figure 5:
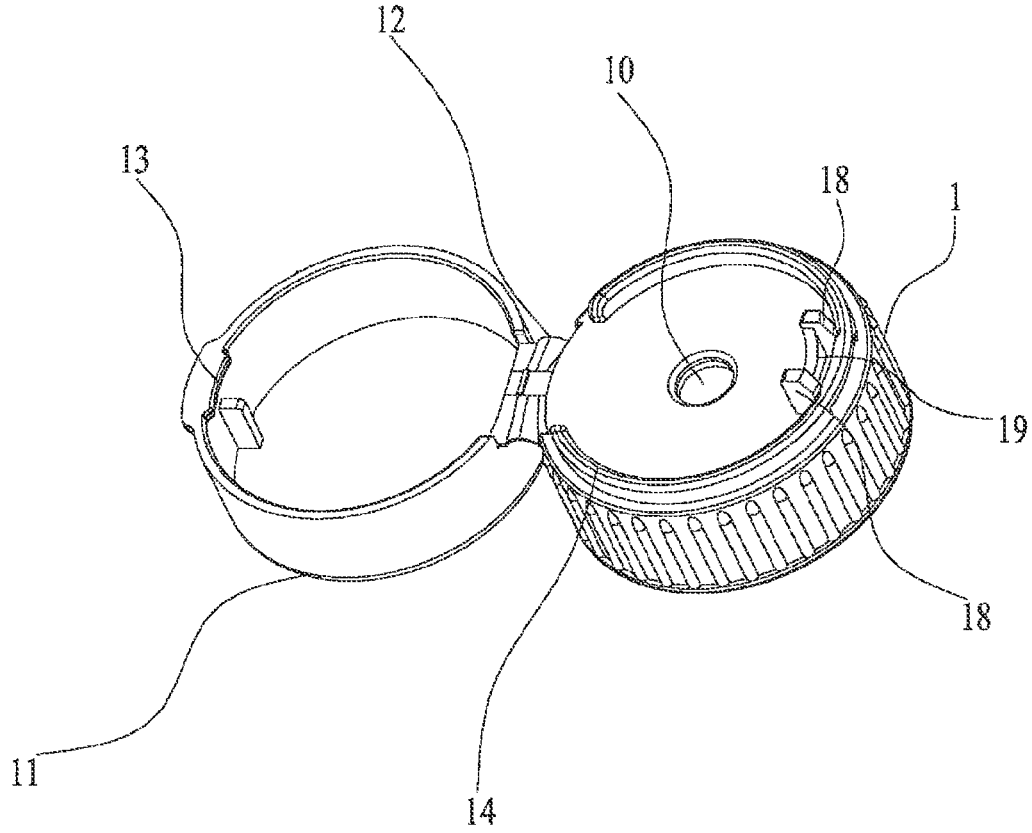
FIG. 5 is the partial structure drawing of the bottle top.
Figure 6:
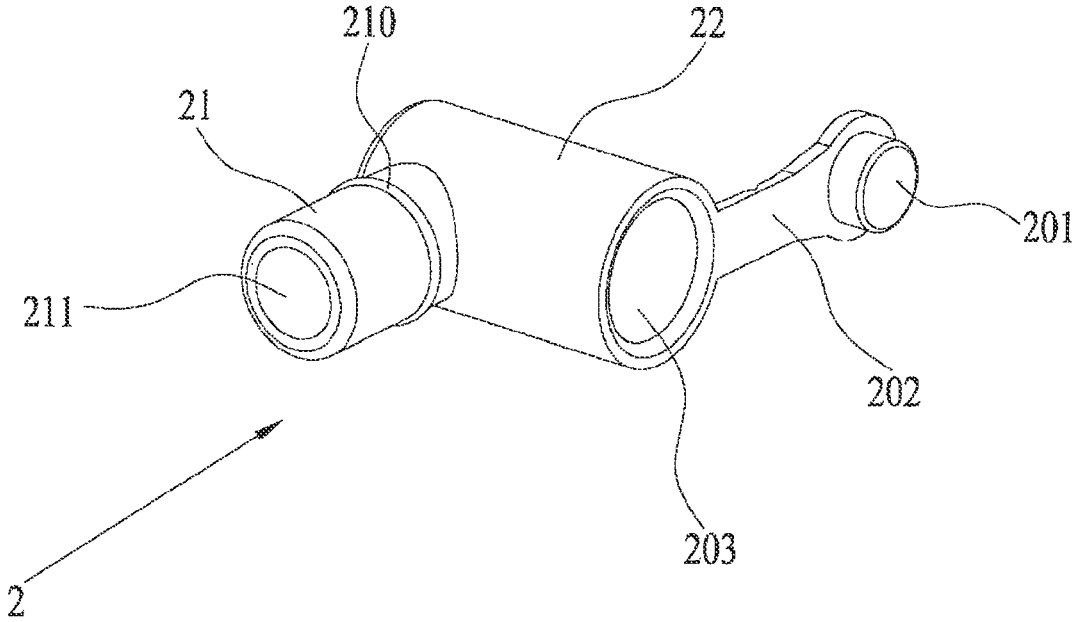
FIG. 6 is the structure drawing of the spray nozzle and the hollow tube.
Figure 7:
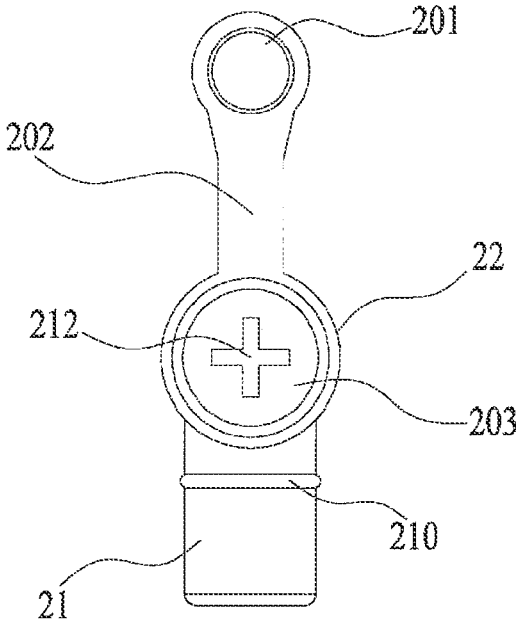
FIG. 7 is the right view of the FIG. 6.
Figure 8:
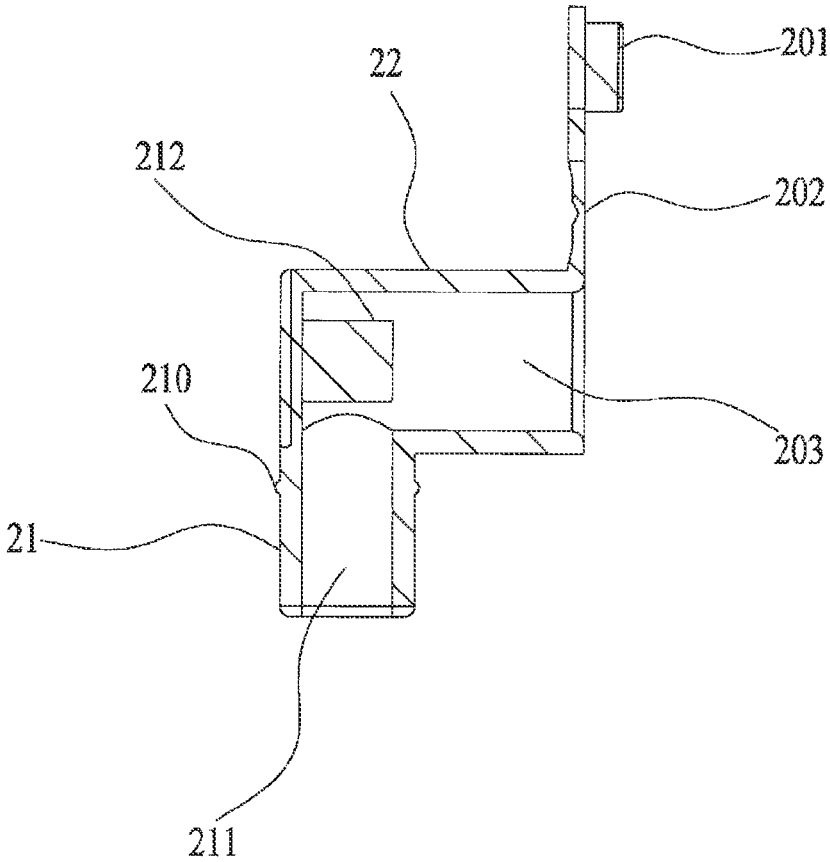
FIG. 8 is the cutaway view of the FIG. 6.
Figure 9:
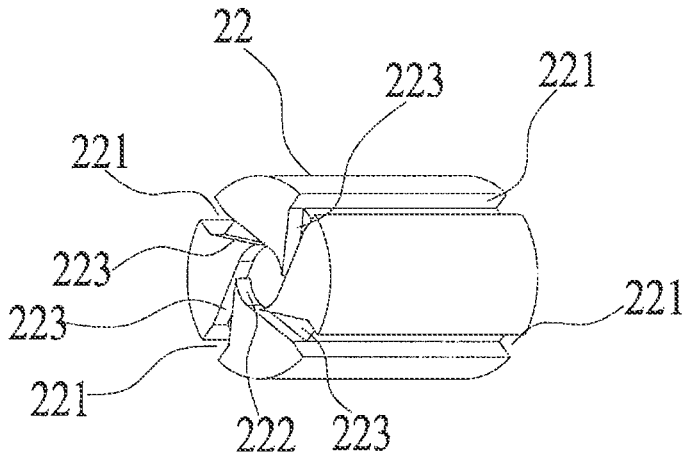
FIG. 9 is the structure drawing of the spool valve.
Figure 10:
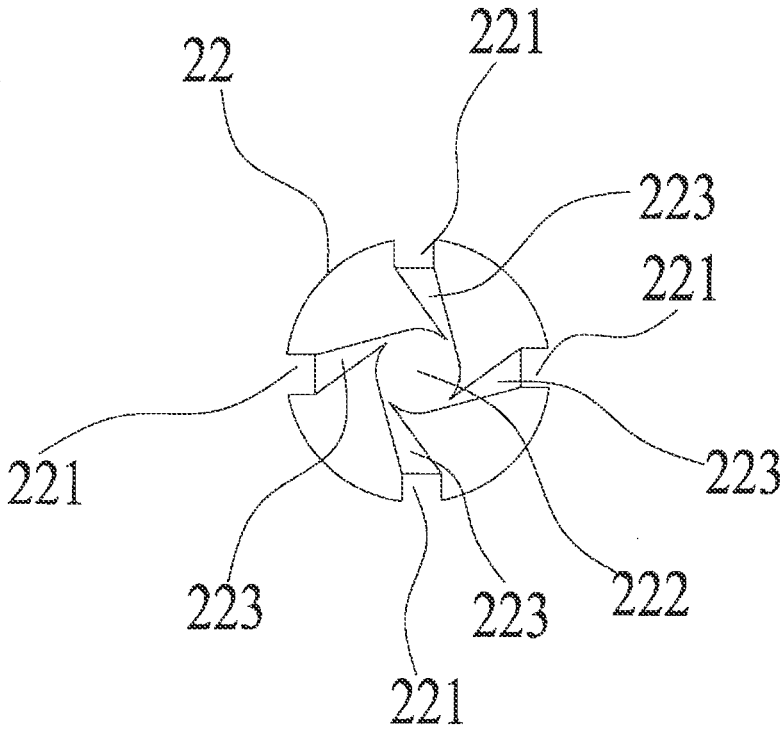
FIG. 10 is the right view of the spool valve of the FIG. 9.
Figure 11:
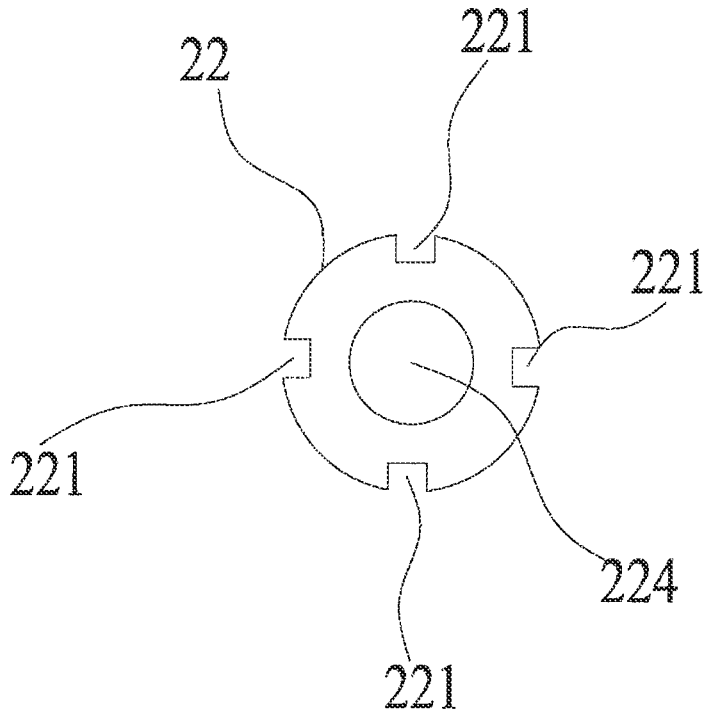
FIG. 11 is the right view of the spool valve of the FIG. 9.
Figure 12:
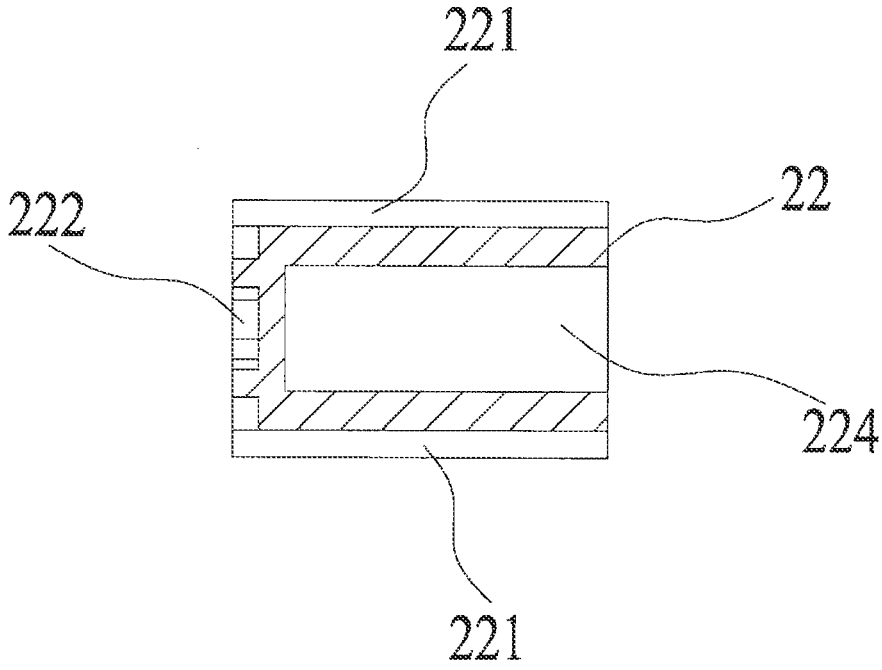
FIG. 12 is the cutaway view of the spool valve of the FIG. 9.
Figure 13:
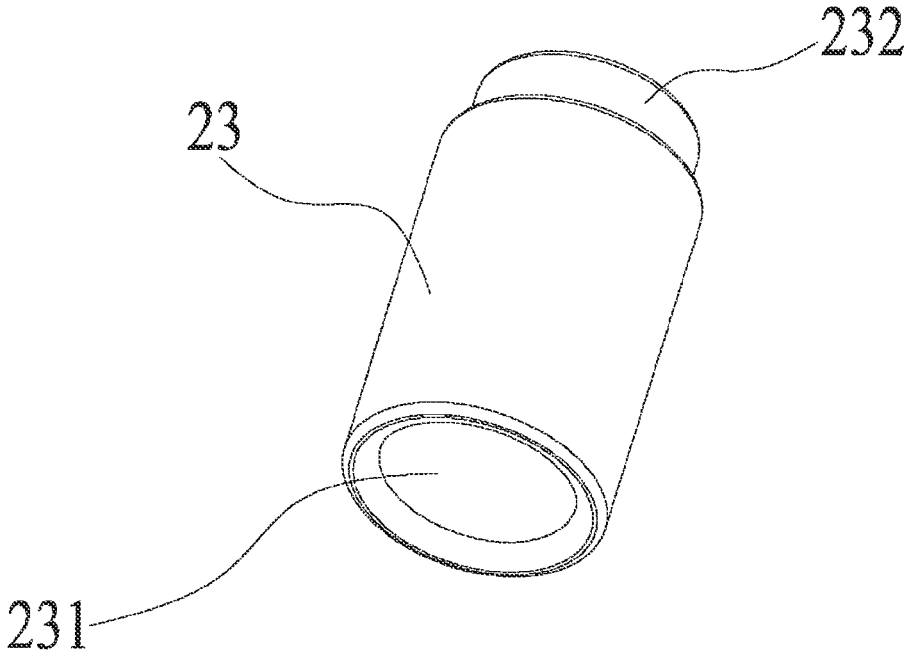
FIG. 13 is the structure drawing of the nozzle.
Figure 14:
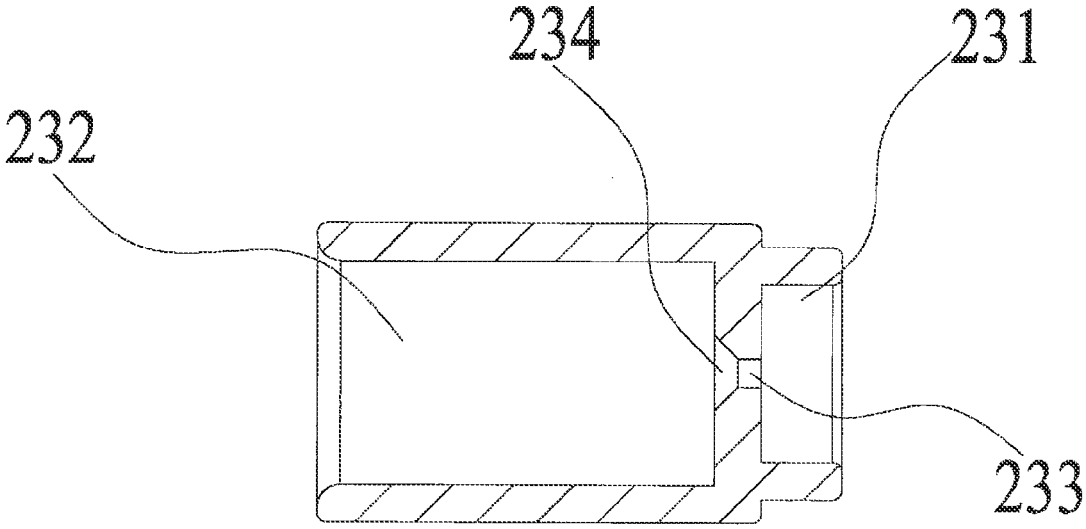
FIG. 14 is the cutaway view of the FIG. 13.

Further explanation to the invention is stated below combining with the attached figures:

As shown from FIG. 1 to FIG. 14, A multifunctional spraying mineral water bottle, including:

An elastic deformation bottle 100, wherein there is an opening in the bottle 100;

A bottle top 1, wherein the bottle top 1 has a liquid-tight manner connection with the opening of the bottle; the bottle top 1 has an inner cover 11, wherein the inner cover 11 movably connects with the bottle top 1 by an elastic interconnecting piece 12; there is an axial through-hole 10 in the center of the bottle top 1, wherein the inside wall of the axial through-hole 10 has an annular notch, while in the surface of the head face of the bottle top 1 has an annular spacing convexity 14, wherein the outer diameter of the annular spacing convexity 14 is in coordination with the inside diameter of the inner cover 11; meanwhile, between the bottle top 1 and the inner cover 11 has a clip device, wherein the clip device is composed by the card slot 15 in the annular convexity 14 in the front end of the bottle top and the block 13 in the inner cover 11 corresponding to the card slot 15.

A sprayer unit, including corner joint 2, atomization spool valve 22 and nozzle 23, wherein the corner joint 2 is composed by a fixed standpipe 21 and a hollow tube 20 that has an 90 degree included angle with the fixed standpipe, while in the outer wall of the fixed standpipe 21 has an annular convexity 210, and the fixed standpipe 21 has a liquid-tight manner and interference fit joint with the axial through-hole 10 of the bottle top 1, and the annular convexity 210 is in coordination with the annular notch inside the axial through-hole 10; the inside wall of the cavity 211 of the fixed standpipe 21 has a cross-shaped atomization spool valve prop 212 that has the same axis with the cylindrical cavity 203 in the hollow tube 20. Inside the hollow tube 20 has a cylindrical cavity 203, and the front end has a cap body 201 wherein the cap body 201 connects with the hollow tube by an elastic interconnecting piece 202. The outer wall of the atomization spool valve 22 has four central symmetry water guide tanks 221 (two water guide tanks are enough to realize the spraying effect, and the number of the water guide tanks should follow the central symmetry principle between the tanks, we use four water guide tanks in the implementation for explanation), and there is an atomized tank corresponding to the water guide tank 221 in the head face of atomization spool valve 22 corresponding to the end of the water guide tank 221; the atomized tank includes a cylindrical tank 222 and four connecting tanks 223 that separately connects with the water guide tanks 221, and one end of the two inner walls of each connecting tank 223 separately connects with the two inner walls of the water guide tanks 221, and the other end contacts with the circumferential surface of the cylindrical tank 222. In the other end of the atomization spool valve 22 has an opening 224, to save the material and reduce the weight of the atomization spool valve. There is a spray hole 233 which has the same axis with the atomization spool valve 22 in the axial position of the nozzle 23 section, the front end of the nozzle 23 has a notch 231, the rear end has cylindrical cavity 232, wherein the atomization spool valve 22 has a concentric interference fit joint with the cylindrical cavity 232, while the back end of the nozzle 23 has a liquid-tight manner connection with the cylindrical cavity 203 of the corner joint 2. Inside the spray hole 233 of the nozzle 23 has a conical cavity 234 which is coaxial with the spray hole 233, wherein the diameter of the rear section of the conical cavity 234 is coordinate with the diameter of the cylindrical tank 222 of the atomized tank, while the diameter of the front end section is the same with the bore diameter of the spray hole 233.

In order to better fixate the nozzle, the foresaid bottle top 1 has a nozzle bracket corresponding to the place of the nozzle 23, wherein the bracket includes cylindrical body 18 in both sides and the cambered supporting bracket 19 in the middle of the two cylindrical bodies.

When using the invention, if there is a large amount of water in the bottle 100, we could open the inner cover 11 and the cap body 201, and squeeze the bottle 100 directly on its edge, so that the water flow through to the cavity 211 of the fixed standpipe 21 by the axial through-hole 10 in the bottle top 1, and by the gap of the cross-shaped prop 212 to the water guide tank 221 of the atomization spool valve 22 to the atomized tank and spray from the spray hole 233, to realize the spray or drink. Meanwhile, during the outdoors or in the surrounding environment of heavy dust and hot weather, the portable air-conditioning unit of the invention, by means of inverting the mineral water bottle, and turning the nozzle to human body or surroundings, then squeezing the bottle, to achieve the spraying in the air, so as to reduce the temperature around the human body, meanwhile to make the settlement by the combination of dust and mist, so that people feel more cool, fresh and comfortable. If the water in the bottle is not so much, we could by means of inverting the bottle and squeeze the bottle to realize the spraying or drinking or air conditioning, which is practical and has greater economic value.

What is claimed is:

1. A multifunctional spraying mineral water bottle, comprising:

an elastic deformation bottle, wherein there is an opening in the bottle;

a bottle top, wherein the bottle top has a liquid-tight manner connection with the opening of the bottle and there is an axial through-hole in the bottle top;

a sprayer unit comprises a corner joint, an atomization spool valve and a nozzle, wherein the corner joint comprises a fixed standpipe and a hollow tube that has an included angle with the fixed standpipe, and the fixed standpipe has a liquid-tight manner and interference fit joint with the axial through-hole of the bottle top, inside the hollow tube is a cylindrical cavity that houses the atomization spool valve and coordinates with the nozzle; an external wall of the atomization spool valve has at least two water guide tanks, a cylindrical tank is located in an end of the atomization spool valve distal from the fixed standpipe; the at least two water guide tanks each being connected to the cylindrical tank by a corresponding connecting tank; a width of the corresponding connecting tank decreases as the distance from the cylindrical tank is decreased, another end of the atomization spool valve, opposite from the cylindrical tank, having an opening defined therein, the opening extending along a longitudinal axis of the atomization spool valve for a majority of a length of the atomization spool valve as measured perpendicularly to the end in which the cylindrical tank is located; a spray hole is positioned in the nozzle and aligned coaxially with the atomization spool valve in the axial position of the nozzle section, and the spray hole is connected with the cylindrical tank; in between the spray hole and the cylindrical tank is a conical cavity that decreases in diameter in a direction from the cylindrical tank to the spray hole;

wherein any air that enters and any liquid that is expelled from the multifunctional spaying mineral water bottle travels along a same portion of a common and single fluid path such that the any air that enters and the any liquid that is expelled each travel along a same section of an identical, single route between the nozzle and an interior of the elastic deformation bottle, the multifunctional spaying mineral water bottle is configured to expel liquid stored therein based on deformation of the bottle.

2. A multifunctional spraying mineral water bottle as set forth in claim 1, characterized in that the foresaid corner joint is composed by a fixed standpipe and a hollow tube that has an 90 degree included angle with the fixed standpipe, and an inside wall of the fixed standpipe has a cross-shaped atomization spool valve prop that is coaxial with the cylindrical cavity.

3. A multifunctional spraying mineral water bottle as set forth in claim 1, wherein the at least two water guide tanks comprise four water guide tanks symmetrically located along the external wall of the atomization spool valve.

4. A multifunctional spraying mineral water bottle as set forth in claim 1, characterized in that the foresaid front end of the nozzle has a notch and a cap body that coordinates with the notch.

5. A multifunctional spraying mineral water bottle as set forth in claim 2, characterized in that foresaid front end of the nozzle has a notch and a cap body that coordinates with the notch.

6. A multifunctional spraying mineral water bottle as set forth in claim 4, characterized in that the foresaid cap body is placed in the front end of the hollow tube of the corner joint, wherein the cap body connects with the hollow tube by an elastic interconnecting piece.

7. A multifunctional spraying mineral water bottle as set forth in claim 1, characterized in that the foresaid rear end of the nozzle is cylindrical, wherein the atomization spool valve has a concentric interference fit joint with the cylinder, while the rear end cylinder of the nozzle has a liquid-tight manner connection with the cylindrical cavity of the corner joint.

8. A multifunctional spraying mineral water bottle as set forth in claim 4, characterized in that the foresaid rear end of the nozzle is cylindrical, wherein the atomization spool valve has a concentric interference fit joint with the cylinder, while the rear end cylinder of the nozzle has a liquid-tight manner connection with the cylindrical cavity of the corner joint.

9. A multifunctional spraying mineral water bottle as set forth in claim 1, wherein the diameter of the rear section of the conical cavity is coordinate with the diameter of a cylindrical tank and the diameter of the front end section is the same with the bore diameter of the spray hole.

10. A multifunctional spraying mineral water bottle as set forth in claim 1, characterized in that the inside wall of the foresaid axial through-hole has an annular notch, while there is an annular convexity in the fixed standpipe corresponding to the location of the annular notch, and the annular convexity has a liquid-tight manner connection with the annular notch.

11. A multifunctional spraying mineral water bottle as set forth in claim 1, characterized in that the foresaid cap body has a nozzle bracket corresponding to the place of the nozzle, wherein the bracket includes spaced apart cylindrical bodies on both sides of the nozzle and a cambered supporting bracket connecting the two cylindrical bodies.

12. A multifunctional spraying mineral water bottle as set forth in claim 4, characterized in that the foresaid cap body has a nozzle bracket corresponding to the place of the nozzle, wherein the bracket includes spaced apart cylindrical bodies on both sides of the nozzle and a cambered supporting bracket connecting the two cylindrical bodies.

13. A multifunctional spraying mineral water bottle as set forth in claim 1, characterized in that the foresaid cap body has an inner cover, wherein the inner cover movably connects with the cap body by an elastic interconnecting piece; in the surface of the cap body has an annular spacing convexity, wherein the outer diameter of the annular spacing convexity in coordination with the inside diameter of the inner cover; the front end of a cap body has a clip device, wherein the clip device is composed by the block in the inner cover and a card slot in the annular spacing convexity.

* * * * *